US005789146A

United States Patent [19]

Miller et al.

[11] Patent Number: 5,789,146

[45] Date of Patent: Aug. 4, 1998

[54] BLENDS OF COUPLERS WITH HOMOLOGOUS BALLASTS

[75] Inventors: David Darrell Miller; Paul Barrett Merkel; Raymond Peter Scaringe, all of Rochester, N.Y.

[73] Assignee: Eastman Kodak Company, Rochester, N.Y.

[21] Appl. No.: 689,852

[22] Filed: Aug. 15, 1996

Related U.S. Application Data

[60] Provisional application No. 60/002,585 Aug. 21, 1995.

[51] Int. Cl.[6] ..... G03C 1/08; G03C 7/26; G03C 7/32

[52] U.S. Cl. ..... 430/549; 430/543; 430/546; 430/552; 430/553; 430/554; 430/555; 430/556; 430/557; 430/558

[58] Field of Search ..... 430/549, 543, 430/546, 552, 553, 554, 555, 556, 557, 558

[56] References Cited

U.S. PATENT DOCUMENTS

| | | | |
|---|---|---|---|
| 4,594,314 | 6/1986 | Kimura et al. | 430/549 |
| 4,885,234 | 12/1989 | Zengerle | 430/546 |
| 4,980,267 | 12/1990 | Taber | 430/549 |
| 5,124,241 | 6/1992 | Ogawa et al. | 430/505 |
| 5,192,651 | 3/1993 | Tsukahara et al. | 430/549 |
| 5,332,656 | 7/1994 | Bertoldi et al. | 430/549 |
| 5,399,472 | 3/1995 | Hall et al. | 430/549 |
| 5,667,946 | 9/1997 | Boff et al. | 430/549 |

FOREIGN PATENT DOCUMENTS

| | | |
|---|---|---|
| 254151 | 1/1988 | European Pat. Off. . |
| 208146 B1 | 1/1993 | European Pat. Off. . |
| 3624777 | 1/1988 | Germany . |
| 1424454 | 2/1976 | United Kingdom . |

*Primary Examiner*—Geraldine Letscher
*Attorney, Agent, or Firm*—Andrew J. Anderson

[57] ABSTRACT

Coupler dispersions comprising an aqueous medium having dispersed therein an organic phase comprising (i) a primary photographic coupler comprising a first ballasting group containing at least 5 carbon atoms and (ii) an auxiliary photographic coupler comprising a second ballasting group, wherein the primary coupler and the auxiliary coupler are present in the dispersion at a weight ratio of from 4:1 to 99:1 and the auxiliary coupler differs from the primary coupler solely in that the second ballast group contains 2 or more additional carbon atoms and associated hydrogen atoms relative to the first ballasting group. Such dispersions are substantially free from crystallization on melt holding or on cold storage, provide direct dispersions without such crystallization problems, provide cost or performance improvements by minimizing the proportion of auxiliary coupler needed to eliminate crystallization problems, and provide photographic materials of improved coatability, of lower cost, or of improved performance.

23 Claims, No Drawings

BLENDS OF COUPLERS WITH HOMOLOGOUS BALLASTS

CROSS REFERENCE TO RELATED APPLICATION

Reference is made to and priority claimed from U.S. Provisional U.S. application Ser. No. US 60/002,585, filed Aug. 21, 1995, entitled BLENDS OF COUPLERS WITH HOMOLOGOUS BALLASTS.

FIELD OF THE INVENTION

This invention relates to coupler dispersion compositions comprising blends of a primary coupler with small amounts of one or more auxiliary couplers. This invention further relates methods for forming such coupler blends, and to photographic materials comprising such coupler blends.

BACKGROUND OF THE INVENTION

Photographic couplers are compounds used in photographic materials for the formation of dyes in an imagewise manner upon reaction with oxidized developer generated by reaction of color developer with exposed silver halide grains. Such couplers may also used in the imagewise generation of photographically useful groups, such as development inhibitors, bleach accelerators or removable dyes, via reaction with oxidized color developer.

Photographic couplers are commonly dispersed together with one or more high-boiling solvents (coupler solvents), optionally with one or more low-boiling or water-miscible auxiliary solvents, as small droplets in aqueous gelatin solutions. These coupler-containing dispersions are then coated (after removal of any auxiliary solvent) on a support to provide photographic materials such as color films and color papers.

One problem that is often encountered with such dispersions is the crystallization of the coupler on cold storage or on holding at elevated temperatures (e.g. 45° C.) in the coating process. Often a coupler solvent cannot be identified that will reduce such crystallization to acceptable levels, and often a coupler with otherwise excellent photographic properties must be rejected for this reason.

While coupler dispersions are often made with one or more auxiliary solvent, such as ethyl acetate, that is removed from the dispersion by washing or evaporation prior to coating, it is desirable to prepare coupler dispersions without such auxiliary solvents for reasons of economy and simplicity. Dispersions of coupler and coupler solvent prepared without removable auxiliary solvent will be referred to subsequently as direct dispersions. It is often difficult to dissolve coupler with coupler solvent alone to prepare such direct dispersions, however, and crystallization during preparation, cold storage or melt hold often occurs with such dispersions.

Blends of couplers of similar structure have been used in dispersions and in photographic materials. Coupler blending may aid dispersion preparation and reduce propensity for coupler crystallization. The proportions of the couplers utilized in prior art blends are often quite similar. EPA 208146, e.g., discloses a blend of a first cyan coupler and an equal weight of a second similar coupler having two additional carbon atoms in the coupler ballast group relative to the first coupler. The use of an auxiliary coupler at similar levels to the primary coupler, however, can reduce cost and performance advantages which may be associated with the primary coupler. Blends of structurally similar couplers with dissimilar ballast groups that do not differ simply in the number of carbon atoms have also been disclosed. U.S. Pat. No. 5,192,651, e.g., discloses the use of two phenol type cyan couplers having structurally dissimilar ballast groups in a single photographic element. Blending couplers with structurally dissimilar groups, however, can reduce efficiency and increase coupler manufacturing costs relative to blending couplers with similar ballasts, and may result in undesirable hue changes.

It would be desirable to provide photographic coupler dispersions, and photographic materials containing them, which are substantially free from crystallization problems on melt hold or on cold storage, without substantially reducing cost and performance advantages which may be associated with a primary coupler, and without substantially reducing coupler efficiency and increasing coupler manufacturing costs. It would be further desirable to prepare direct dispersions without crystallization problems.

SUMMARY OF THE INVENTION

One object of this invention is to provide dispersions which are free from crystallization on melt holding or on cold storage. A second object of the invention is to provide direct dispersions without such crystallization problems. A third objective of this invention is to provide cost or performance improvements by minimizing the proportion of auxiliary coupler needed to eliminate crystallization problems. A fourth objective of this invention is to provide photographic materials of improved coatability, of lower cost, or of improved performance.

These and other objects are achieved in accordance with the dispersions of the invention which comprise blends of primary ballasted couplers together with small amounts (e.g., 1 to 20% of total coupler weight) of one or more auxiliary ballasted couplers that differ only in a ballast group that contains at least two and preferably 3–10 additional carbon atoms together with associated hydrogen atoms.

The coupler dispersions in accordance with one embodiment of the invention comprise an aqueous medium having dispersed therein an organic phase comprising (i) a primary photographic coupler comprising a first ballasting group containing at least 5 carbon atoms and (ii) an auxiliary photographic coupler comprising a second ballasting group, wherein the primary coupler and the auxiliary coupler are present in the dispersion at a weight ratio of from 4:1 to 99:1 and the auxiliary coupler differs from the primary coupler solely in that the second ballast group contains 2 or more additional carbon atoms and associated hydrogen atoms relative to the first ballasting group.

Further embodiments of the invention include photographic elements comprising one or more light-sensitive silver halide emulsion layers coated on a support and one or more coupler dispersions as described above coated in one or more layers on the support, as well as processes for forming such coupler dispersions comprising codispersing the primary and auxiliary couplers with a permanent coupler solvent at a weight ratio of total coupler:coupler solvent of from 1:0.1 to 1:8.0 in the absence of any removable auxiliary solvent.

In preferred embodiments of the invention, the ballasted primary coupler comprises at least 80% by weight of the total coupler in the dispersion, and the auxiliary ballasted coupler comprises from 1 to 20% by weight of the total coupler in the dispersion. In further preferred embodiments of the invention, the dispersed organic phase also preferably comprises one or more high-boiling coupler solvents, and the primary coupler is a ballasted cyan, magenta or yellow dye-forming coupler.

DETAILED DESCRIPTION OF THE INVENTION

The coupler blends of this invention minimize or eliminate coupler crystallization and aid in dispersion preparation at surprisingly low levels of auxiliary coupler. This is accomplished by the use of novel blends of primary couplers with homologous ballast groups having suitable additional carbon atoms as described below. Prior disclosures of coupler blends have not utilized low proportions of higher molecular weight homologs nor have they taught the relationships between the structures of homologous couplers that are best suited for blending.

The couplers comprising the coupler blends of this invention may be, e.g., imaging couplers or couplers that release a photographically useful group, such as development inhibitor releasing (DIR) couplers, bleach accelerator-releasing (BAR) couplers or colored masking couplers that release or destroy a dye upon coupling. Representative photographic couplers which may be used in the dispersions of the invention are disclosed in *Research Disclosure*, September 1994, Item 36544, published by Kenneth Mason Publications, Ltd., Dudley House, 12 North Street, Emsworth, Hampshire P010 7DQ, ENGLAND. The contents of the *Research Disclosure*, including the patents and publications referenced therein, are incorporated herein by reference. In a preferred embodiment of the invention, the primary coupler is a ballasted cyan, magenta or yellow image dye-forming coupler. The auxiliary coupler may, and preferably does, provide a similar function as the primary coupler.

Image dye-forming couplers that form cyan dyes upon reaction with oxidized color developing agents which may be included in the invention include those described in such representative patents and publications as: U.S. Pat. Nos. 2,772,162; 2,895,826; 3,002,836; 3,034,892; 2,474,293; 2,423,730; 2,367,531; 3,041,236; 4,883,746 and "Farbkuppler - Eine Literature Ubersicht," published in Agfa Mitteilungen, Band III, pp. 156–175 (1961). Preferably such couplers are phenols or naphthols, such as 2-ureido-5-carbonamidophenols, that form cyan dyes on reaction with oxidized color developing agent.

Couplers that form magenta dyes upon reaction with oxidized color developing agent which may be included in the invention include those described in such representative patents and publications as: U.S. Pat. Nos. 2,600,788; 2,369,489; 2,343,703; 2,311,082; 3,152,896; 3,519,429; 3,062,653; 2,908,573 and "Farbkuppler - Eine Literature Ubersicht," published in Agfa Mitteilungen, Band III, pp. 126–156 (1961). Preferably such couplers are pyrazolones (including 1-phenyl-5-pyrazolones), pyrazolotriazoles, or pyrazolobenzimidazoles that form magenta dyes upon reaction with oxidized color developing agents.

Couplers that form yellow dyes upon reaction with oxidized color developing agent which may be included in the invention include those described in such representative patents and publications as: U.S. Pat. Nos. 2,875,057; 2,407,210; 3,265,506; 2,298,443; 3,048,194; 3,447,928 and "Farbkuppler - Eine Literature Ubersicht," published in Agfa Mitteilungen, Band III, pp. 112–126 (1961). Preferably such couplers are open chain ketomethylene compounds, such as pivaloylacetanilide compounds, that form yellow dyes upon reaction with oxidized color developing agents.

The couplers comprising the dispersion blends of this invention may comprise a coupling-off group. Coupling-off groups are generally organic groups which are released during photographic processing. The released coupling-off group can be a photographically useful group. Coupling-off groups are well known in the art. Such groups can determine the chemical equivalency of a coupler, i.e., whether it is a 2-equivalent or a 4-equivalent coupler, or modify the reactivity of the coupler. Such groups can advantageously affect the layer in which the coupler is coated, or other layers in the photographic recording material, by performing, after release from the coupler, functions such as dye formation, dye hue adjustment, development acceleration or inhibition, bleach acceleration or inhibition, electron transfer facilitation, color correction and the like.

Generally the presence of hydrogen at the coupling site provides a 4-equivalent coupler, and the presence of another coupling-off group usually provides a 2-equivalent coupler. Representative classes of such coupling-off groups include, for example, chloro, alkoxy, aryloxy, hetero-oxy, sulfonyloxy, acyloxy, acyl, heterocyclyl, sulfonamido, mercaptotetrazole, benzothiazole, mercaptopropionic acid, phosphonyloxy, arylthio, and arylazo. These coupling-off groups are described in the art, for example, in U.S. Pat. Nos. 2,455,169; 3,227,551; 3,432,521; 3,476,563; 3,617,291; 3,880,661; 4,052,212; and 4,134,766; and in U.K. Patents and published application Nos. 1,466,728; 1,531,927; 1,533,039; 2,006,755A; and 2,017,704A, the disclosures of which are incorporated herein by reference.

The coupler blends of the invention may comprise or may be used in association with "wrong" colored couplers (e.g. to adjust levels of interlayer correction) and, in color negative applications, with masking couplers such as those described in EP 213,490; Japanese Published Application 58-172,647; U.S. Pat. No. 2,983,608; German Application DE 2,706,117C; U.K. Patent 1,530,272; Japanese Application A-113935; U.S. Pat. Nos. 4,070,191 and 4,273,861; and German Application DE 2,643,965. The masking couplers may be shifted or blocked.

Ballasting groups usually comprise one or more 5 to 25 carbon atom containing organic moieties whose function is to immobilize a coupler and formed image dyes during photographic development by imparting poor water diffusibility to the compound. The ballast groups utilized on the primary couplers comprising the coupler blends of this invention preferably contain at least 6 carbon atoms, and more preferably contain from 10–24 carbon atoms. The ballast groups utilized for the couplers comprising the coupler blends of these invention may be, e.g., alkyl or aryl (-R), alkoxy or aryloxy (-OR), aryloxycarbonyl or alkoxycarbonyl ($-CO_2R$), acyloxy (-OCOR), acyl (-COR), carbonamido (-NRCOR'), carbamoyl (-CONRR'), sulfonamido ($-NRSO_2R'$), sulfamoyl ($-SO_2NRR'$), sulfonyl ($-SO_2R$), sulfoxyl (-SOR), sulfonate ($-OSO_2R$), ureido (-NRCONR'R"), -carbamate ($-NRCO_2R'$) or diacylamino (-N(C(O)R) (C(O) R')) groups, wherein R, R' and R" each represent branched or unbranched alkyl or aryl groups which may be further substituted as is known in the art.

The ballast group of the auxiliary coupler of the coupler blends of this invention contains at least two carbon atoms, preferably at least three carbon atoms, and more preferably at least 4 carbon atoms (plus associated hydrogen atoms) more than the analogous ballast of the otherwise identical primary coupler. Use of low levels of the auxiliary coupler may be facilitated in many cases when the auxiliary coupler ballast contains 3–10 more carbon atoms than the primary coupler ballast. Thus, auxiliary couplers with 3–10 additional carbon atoms are preferred. In a particularly useful practice of this invention, the additional carbon atoms in the auxiliary coupler ballast constitute 3 or more methylene (—$CH_2$—) groups in a homologous chain. In other useful embodiments of this invention, the additional carbon atoms are part of an added branched alkyl group, a cycloalkyl group or a phenyl group.

Ballast groups are most commonly retained on the coupler upon reaction of the coupler with oxidized color developing agents, but may also be located on a coupling-off group. Where it is desired to completely match hues of dyes formed from the primary and auxiliary coupler pairs of the invention, the homologous ballast groups may be located on a coupling-off group, whereby the different ballasts are removed upon reaction of the couplers with oxidized developer and identical dyes are formed.

The primary coupler and the auxiliary coupler are present in the dispersions of the invention at a weight ratio of from 4:1 to 99:1. Preferably, the auxiliary couplers used in the dispersion blends constitute from 1 to 20% by weight of the total coupler in the dispersion, and more preferably from 3 to 15%. The auxiliary couplers of this invention may aid dispersion preparation and retard coupler crystallization partially by forming eutectic mixtures with the primary couplers of this invention. The auxiliary couplers of this invention may also reduce coupler crystallization by serving as growth modifiers that attach to the surface of and retard the growth of seed crystals. The surprising ability of the homologous auxiliary couplers of this invention to function at such low levels may derive from such growth modification properties. In a further preferred embodiment of the invention, the auxiliary coupler is present at 3 to 15% by weight of the primary coupler.

Blended coupler dispersions of this invention are preferably prepared by dispersing mixtures of the primary and auxiliary couplers together with a high-boiling "permanent" organic coupler solvent and/or removable auxiliary solvent as small particles in aqueous solutions of gelatin or other hydrophilic colloid and surfactant, using conventional milling or homogenization dispersion techniques. Devices suitable for high-shear or turbulent mixing include those generally suitable for preparing submicron photographic emulsified dispersions. These include but are not limited to blade mixers, rotor-stator mixers, devices in which a liquid stream is pumped at high pressure through an orifice or interaction chamber, sonication, Gaulin mills, homogenizers, blenders, etc. More than one type of device may be used to prepare the dispersions of the invention. In a particularly preferred embodiment of this invention, the blended coupler dispersions are prepared as direct dispersions without the use of removable auxiliary solvents.

High boiling solvents have a boiling point sufficiently high, generally above 150° C. at atmospheric pressure, such that they are not evaporated under normal dispersion making and photographic layer coating procedures. High boiling coupler solvents useful for the practice of this invention include, but are not limited to, aryl phosphates (e.g. tritolyl phosphate), alkyl phosphates (e.g. trioctyl phosphate, tris(2-ethylhexyl)phosphate), mixed aryl alkyl phosphates (e.g. diphenyl 2-ethylhexyl phosphate), phosphine oxides (e.g. trioctylphosphine oxide), esters of aromatic acids (e.g. dibutyl phthalate, Bis(2-ethylhexyl) phthalate, octyl benzoate, 2-phenylethyl benzoate, or benzyl salicylate), esters of aliphatic acids (e.g. acetyl tributyl citrate, dibutyl sebecate, 1,4-Cyclohexylenedimethylene bis(2-ethylhexanoate), 2-(2-Butoxyethoxy)ethyl acetate), alcohols (e.g. 2-hexyl-1-decanol, oleyl alcohol), phenols (e.g. 2,5-Di-t-pentylphenol, p-dodecylphenol), carbonamides (e.g. N,N-dibutyldodecanamide, N,N-diethyldodecanamide, or N-butylacetanalide), sulfoxides (e.g. bis(2-ethylhexyl) sulfoxide), sulfonamides (e.g. N,N-dibutyl-p-toluenesulfonamide), epoxides (e.g., Octyl oleate monoepoxide) or hydrocarbons (e.g. dodecylbenzene). Useful coupler:coupler solvent weight ratios range from about 1:0.1 to 1:8, with 1:0.2 to 1:2 being preferred. Within such ranges, it is usually desirable for environmental considerations to minimize organic solvent levels.

Removable auxiliary organic solvents such as ethyl acetate or cyclohexanone may be used in place of or in addition to high-boiling "permanent" coupler solvents in the preparation of dispersions in accordance with the invention to facilitate the dissolution of the coupler in the organic phase. Additional auxiliary solvents and high boiling coupler solvents which may be used in accordance with the invention are noted in Research Disclosure, December 1989, Item 308119, p 993.

The photographic materials comprising the blended coupler dispersions of this invention may contain one or more of the dispersion blends of this invention in the same layer or in a different layer. Further description of the photographic materials which the blended coupler dispersions of this invention may be incorporated into are provide subsequently.

Examples of primary and auxiliary coupler combinations useful for the practice of this invention include, but are not limited to, the following blends C1–C9, wherein A refers to the primary coupler and B to the auxiliary coupler.

C1

C1A

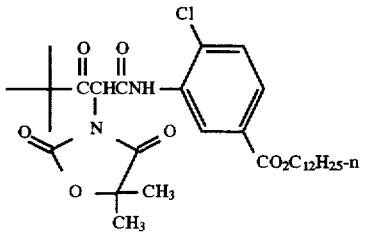

C1B

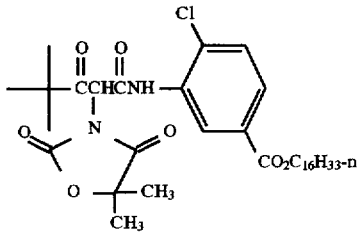

-continued
C2
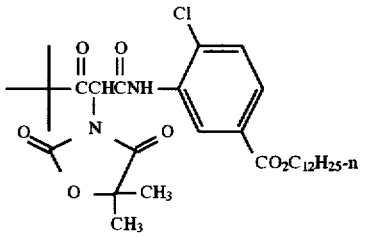
C2A
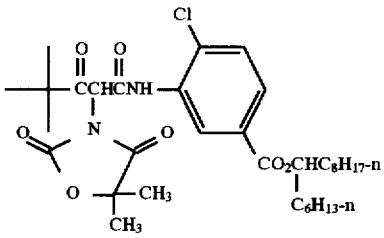
C2B
C3
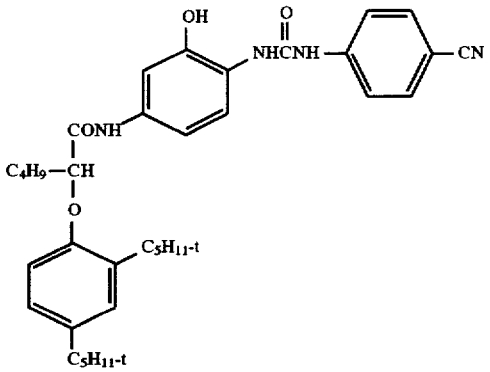
C3A
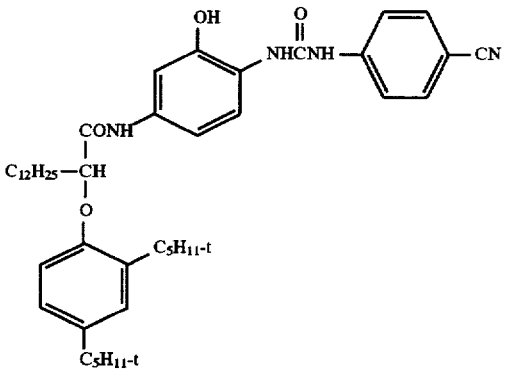
C3B
C4
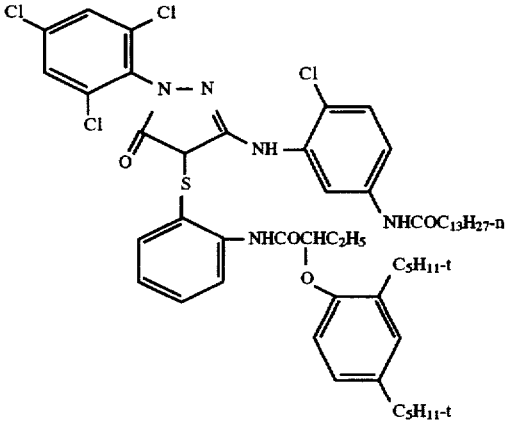
C4A
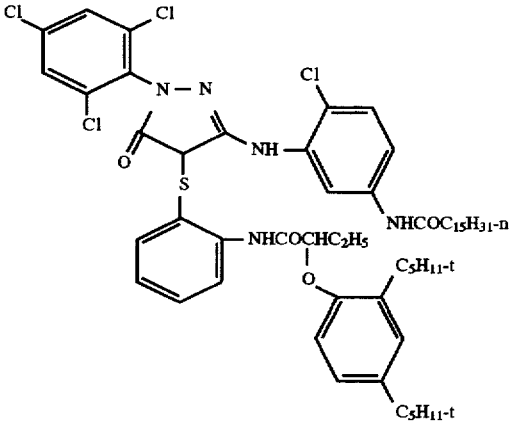
C4B
C5
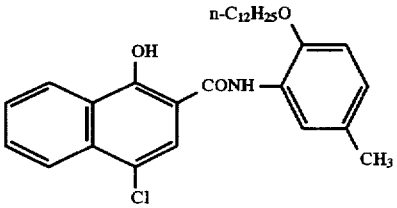
C5A
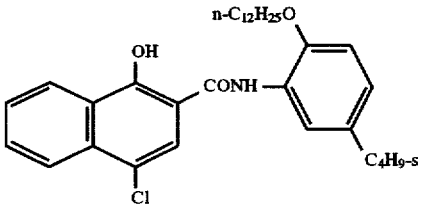
C5B -continued

C6

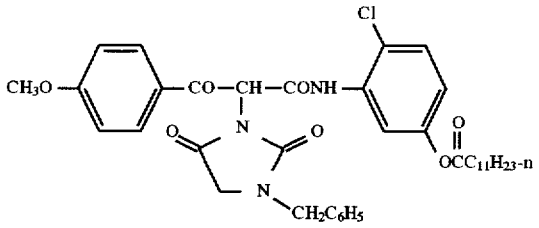

C6A

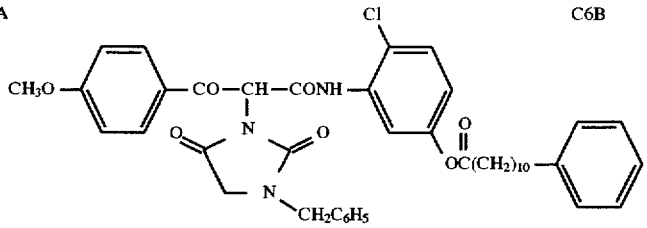

C6B

C7

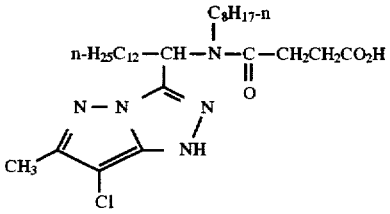

C7A

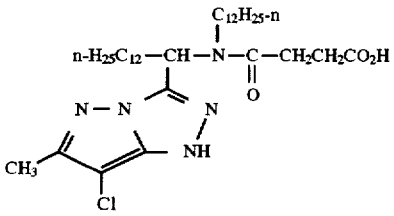

C7B

C8

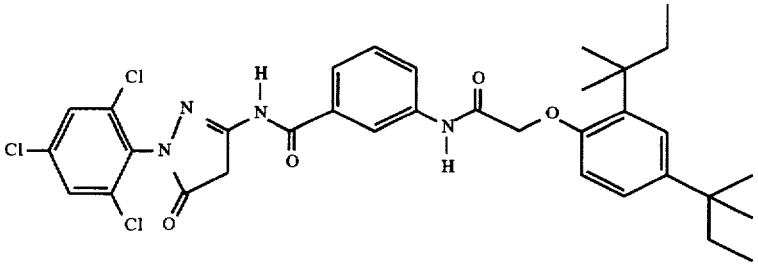

C8A

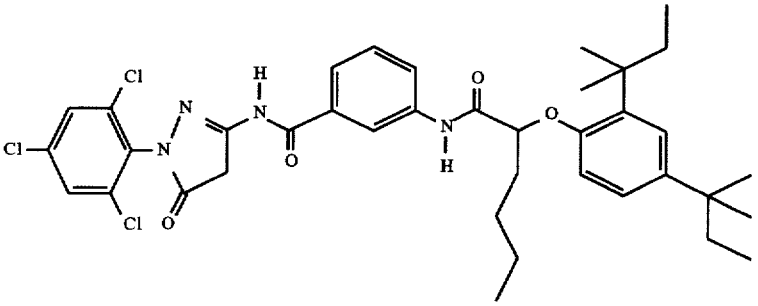

C8B

C9

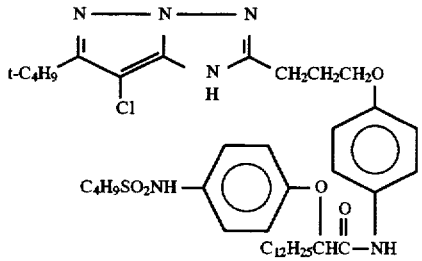

C9A

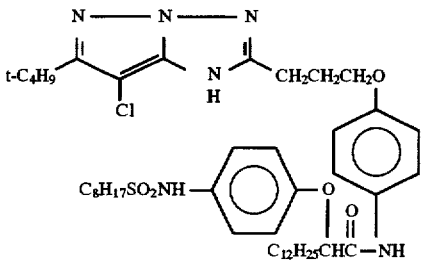

C9B

The dispersions of the invention may comprise a hydrophilic colloid, which is preferably gelatin. This may be gelatin or a modified gelatin such as acetylated gelatin, phthalated gelatin, oxidized gelatin, etc. Gelatin may be base-processed, such as lime-processed gelatin, or may be acid-processed, such as acid-processed ossein gelatin or acid-processed pig gelatin. The hydrophilic colloid may be another water-soluble polymer or copolymer including, but not limited to poly(vinyl alcohol), partially hydrolyzed poly(vinylacetate/vinylalcohol), hydroxyethyl cellulose, poly(acrylic acid), poly(1-vinylpyrrolidone), poly(sodium styrene sulfonate), poly(2-acrylamido-2-methane sulfonic acid), polyacrylamide. Copolymers of these with hydrophobic monomers may also be used.

The photographic elements comprising the dispersions of the invention can be single color elements or multicolor elements. Multicolor elements contain image dye-forming units sensitive to each of the three primary regions of the spectrum. Each unit can comprise a single emulsion layer or multiple emulsion layers sensitive to a given region of the spectrum. The layers of the element, including the layers of the image-forming units, can be arranged in various orders as known in the art. In an alternative format, the emulsions sensitive to each of the three primary regions of the spectrum can be disposed as a single segmented layer.

A typical multicolor photographic element comprises a support bearing a cyan dye image-forming unit comprised of at least one red-sensitive silver halide emulsion layer having associated therewith at least one cyan dye-forming coupler, a magenta dye image-forming unit comprising at least one green-sensitive silver halide emulsion layer having associated therewith at least one magenta dye-forming coupler, and a yellow dye image-forming unit comprising at least one blue-sensitive silver halide emulsion layer having associated therewith at least one yellow dye-forming coupler. The element can contain additional layers, such as filter layers, interlayers, overcoat layers, subbing layers, and the like.

If desired, the photographic element can be used in conjunction with an applied magnetic layer as described in *Research Disclosure*, November 1992, Item 34390 published by Kenneth Mason Publications, Ltd., Dudley House, 12 North Street, Emsworth, Hampshire P010 7DQ, ENGLAND.

In the following discussion of suitable materials for use in the emulsions and elements that can be used in conjunction with this photographic element, reference will be made to *Research Disclosure*, September 1994, Item 36544, available as described above, which will be identified hereafter by the term "*Research Disclosure*." The contents of the *Research Disclosure*, including the patents and publications referenced therein, are incorporated herein by reference, and the Sections hereafter referred to are Sections of the *Research Disclosure*, Item 36544.

The silver halide emulsions employed in these photographic elements can be either negative-working or positive-working. Suitable emulsions and their preparation as well as methods of chemical and spectral sensitization are described in Sections I, and III–IV. Especially useful for use with this invention are tabular grain silver halide emulsions. Specifically contemplated tabular grain emulsions are those in which greater than 50 percent of the total projected area of the emulsion grains are accounted for by tabular grains having a thickness of less than 0.3 micron (0.5 micron for blue sensitive emulsion) and an average tabularity (T) of greater than 25 (preferably greater than 100), where the term "tabularity" is employed in its art recognized usage as $T=ECD/t^2$ where ECD is the average equivalent circular diameter of the tabular grains in microns and t is the average thickness in microns of the tabular grains.

Vehicles and vehicle related addenda are described in Section II. Dye image formers and modifiers are described in Section X. Various additives such as UV dyes, brighteners, luminescent dyes, antifoggants, stabilizers, light absorbing and scattering materials, coating aids, plasticizers, lubricants, antistats and matting agents are described, for example, in Sections VI–IX. Layers and layer arrangements, color negative and color positive features, scan facilitating features, supports, exposure and processing can be found in Sections XI–XX.

It is also specifically contemplated that the dispersions of the invention may also be used in conjunction with the photographic elements described in sections XVII–XIX and XXI of an article titled "Typical and Preferred Color Paper, Color Negative, and Color Reversal Photographic Elements and Processing," published in *Research Disclosure*, February 1995, Volume 370.

Photographic elements can be exposed to actinic radiation, typically in the visible region of the spectrum, to form a latent image and can then be processed to form a visible dye image. Processing to form a visible dye image includes the step of contacting the element with a color developing agent to reduce developable silver halide and oxidize the color developing agent. Oxidized color developing agent in turn reacts with the coupler to yield a dye.

With negative-working silver halide, the processing step described above provides a negative image. The described elements can be processed in the known C-41 color process as described in *The British Journal of Photography Annual* of 1988, pages 191–198. Motion picture films may be processed as described in Kodak Publication No. H-24, Manual For Processing Eastman Color Films. Where applicable, the element may be processed in accordance with color print processes, such as the RA-4 process of Eastman Kodak Company as described in the British Journal of *Photography Annual* of 1988, pages 198–199, the Kodak Ektaprint 2 Process as described in Kodak Publication No. Z-122, using Kodak Ektaprint chemicals, and the Kodak ECP Process as described in Kodak Publication No. H-24, Manual For Processing Eastman Color Films. To provide a positive (or reversal) image, the color development step can be preceded by development with a non-chromogenic developing agent to develop exposed silver halide, but not form dye, and followed by uniformly fogging the element to render unexposed silver halide developable. For elements that lack incorporated dye image formers, sequential reversal color development with developers containing dye image formers such as color couplers is illustrated by the Kodachrome K-14 process (see U.S. Pat. Nos. 2,252,718; 2,950,970; and 3,547,650). For elements that contain incorporated color couplers, the E-6 color reversal process is described in the *British Journal of Photography Annual* of 1977, pages 194–197. Alternatively, a direct positive emulsion can be employed to obtain a positive image.

EXAMPLE 1

A direct dispersion containing the blend C1 (couplers C1A and C1B) was prepared and its crystallization on melt hold and cold storage was compared to a dispersion containing only the primary coupler (C1A). The comparative dispersion, containing only the primary coupler C1A, was prepared by adding an oil phase containing 0.40 g of C1A and 0.40 g of the coupler solvent di-n-butylphthalate to 39.4 ml of an aqueous solution containing 2.38 g of gelatin and 0.24 g of the sodium salt of tri-isopropylnaphthalene sulfonic acid (a dispersing agent). The mixture was then passed through a colloid mill to disperse the coupler-containing oil phase in the aqueous gelatin phase as small particles. A blended dispersion containing couplers C1A and C1B of this invention was prepared similarly, except that the oil phase of the C1 blend consisted of 0.36 g of C1A, 0.04 g of C1B and 0.40 g of di-n-butylphthalate, resulting in a dispersion in which C1B constitutes 10% of the total coupler weight. These are direct dispersions that utilize no removable auxiliary solvent.

The dispersions were examined microscopically at 1000X magnification initially, after holding the melts at 45° C. for 24 hours and after the sequence 24 hours at 45° C., 48 hours at 4° C., 24 hours at 45° C. The later sequence simulates preparation, storage and coating conditions encountered in manufacture of photographic materials. Observations with respect to coupler crystallization are presented in Table I. The comparative dispersion of only C1A showed substantial crystal formation after 24 hours at 45° C. and very extensive crystallization after the 45° C./4° C./45° C. sequence. The blended dispersion of C1A and C1B of this invention showed no evidence of crystallization under either condition.

TABLE I

| Degree of Crystallization Under 1000X Magnification | | | |
|---|---|---|---|
| Dispersion | Fresh | 24 hours 45° C. | 24 hours 45° C./48 hours 4° C./24 hours 45° C. |
| C1A (comparative) | none | some needles some plates | very extensive crystallization |
| C1A/C1B (inventive) | none | none | none |

EXAMPLE 2

A comparative single-coupler dispersion including auxiliary solvent was made by 1) preparing an oil phase consisting of 1.5 g of the cyan dye-forming coupler C3A, 1.5 g of dibutylphthalate and 6.0 g of ethyl acetate and 2) dispersing the oil phase, using a high-shear Ultra-Turrax mixer, into 39.0 g of an aqueous phase consisting of 2.73 g of Type IV gelatin, 2.73 g of a 10% solution of ALKANOL XC (DuPont) and 34.54 g of water. The ethyl acetate in the resulting dispersion was removed by rotary evaporation, and all of the lost mass was replaced by water. A dispersion in accordance with our invention was prepared similarly, except that the 1.5 g of coupler C3A was replaced with 1.35 g of C3A plus 0.15 g (10% of total coupler weight) of the auxiliary coupler C3B.

The two dispersions were incubated at 47° C. for 24 hours and assessed for crystal content using an image analyzer. The image analyzer quantifies the projected area of birefringence due to crystal formation (as a percentage of total area) in polarization photomicrographs taken at 150X. The greatly reduced crystallization with the blended dispersion of this invention as indicated in Table II was readily apparent.

TABLE II

| | Area % Birefringence | |
|---|---|---|
| Dispersion | Fresh | 24 hours at 47° C. |
| C3A (comparative) | 0% | 4.1% |
| C3A/C3B (invention) | 0% | 0.63% |

EXAMPLE 3

A comparative single-coupler direct dispersion was made by 1) preparing an oil phase consisting of 6.0 g of the cyan dye-forming coupler C3A and 6.0 g of dibutylphthalate and 2) dispersing the oil phase, using a high-shear Ultra-Turrax mixer, into 88.0 g of an aqueous phase consisting of 6.0 g of Type IV gelatin, 6.0 g of a 10% aqueous solution of ALKANOL XC (DuPont) and 76.0 g of water. A direct dispersion representing a preferred embodiment of our invention was prepared similarly, except that the 6.0 g of coupler C3A was replaced with 5.4 g of coupler C3A plus 0.6 g (10% of total coupler weight) of the auxiliary homologous coupler C3B. A third direct dispersion, representing a less-preferred embodiment of our invention, was prepared similarly except that the 6.0 g of C3A was replaced with a blend consisting of 5.4 g of C3A and 0.6 g of the cyan coupler C3C having the structure below.

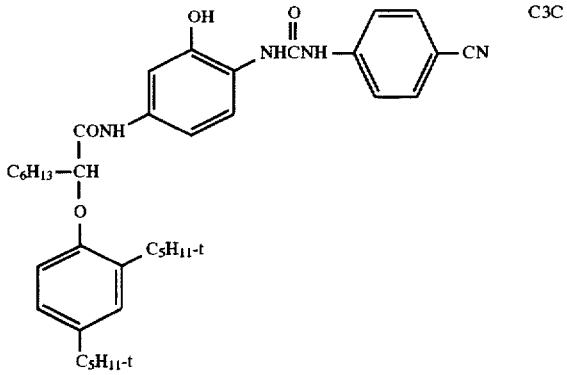

The three dispersions were incubated at 47° C. for 30 hours and assessed for crystal content using an image analyzer. The image analyzer quantifies the projected area of birefringence due to crystal formation (as a percentage of total area) in polarization photomicrographs taken at 150X. Direct dispersion blend C3A/C3C showed a slight improvement, and blended dispersion C3A/C3B in accordance with the more preferred embodiment of the invention exhibited greatly reduced crystallization, as is readily apparent from the data in Table III.

TABLE III

| | Area % Birefringence | |
|---|---|---|
| Dispersion | Fresh | 30 hours at 47° C. |
| C3A (comparative) | 0% | 2.1% |
| C3A/C3B (invention; preferred embodiment) | 0% | 0.3% |
| C3A/C3C (invention) | 0% | 1.9% |

EXAMPLE 4

A single-coupler comparative dispersion including auxiliary solvent was made by 1) preparing an oil phase consisting of 3.0 g of the magenta dye-forming coupler C8A, 1.5 g of tritolylphosphate and 6.0 g of ethyl acetate, and 2) dispersing the oil phase, using a high-shear Ultra-Turrax mixer, into 35.0 g of an aqueous phase consisting of 3.0 g of Type IV gelatin, 2.0 g of a 10% solution of ALKANOL XC (DuPont) and 30.0 g of water. The ethyl acetate in the dispersion was removed by rotary evaporation and the lost mass was replaced by water. A dispersion representing a preferred embodiment of our invention was prepared similarly, except that the 3.0 g of coupler C8A was replaced with 2.7 g of C8A and 0.3 g of the magenta dye-forming coupler C8B. A third dispersion representing a less-preferred embodiment of our invention was also prepared similarly, except that the 3.0 g of coupler C8A was replaced with 2.7 g of C8A and 0.3 g of the magenta dye-forming coupler C8C, having the structure below.

C8C

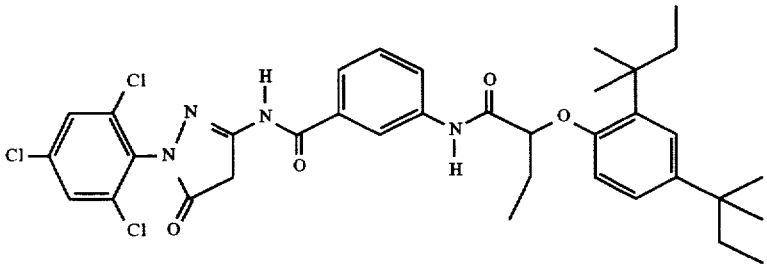

The three dispersions were incubated at 47° C. for 48 hours and assessed for crystal content with an image analyzer, which quantifies crystallization in terms of birefringence. The area percent birefringence values in Table V demonstrate the large reduction in crystallization on incubation for the blended coupler evaporated dispersions of this invention. The reduction to 0.16% for the preferred C8A/C8B blend of this invention vs 100% for C8A alone is particularly remarkable.

TABLE IV

| | Area % Birefringence | |
|---|---|---|
| Dispersion | Fresh | 48 hours at 47° C. |
| C8A (comparative) | 0% | 100% |
| C8A/C8B (invention; preferred embodiment) | 0% | 0.16% |
| C8A/C8C (invention) | 0% | 0.60% |

EXAMPLE 5

A comparative single-coupler dispersion containing no permanent solvent representing the prior art was made by 1) preparing an oil phase consisting of 3.0 g of coupler C8A and 7.5 g of ethyl acetate and 2) dispersing the oil phase, using a high-shear Ultra-Turrex mixer, in 35.0 g of an aqueous phase consisting of 3.0 g of Type-IV gelatin, 2.0 g of a 10% solution of ALKANOL XC (DuPont) and 30.0 g of water. The ethyl acetate in the resulting dispersion was removed by rotary evaporation (leaving a dispersion without permanent coupler solvent), and the lost mass was replaced with water. A dispersion representing our invention was prepared similarly, except that the 3.0 g of coupler C8A was replaced with 2.7 g of C8A and 0.3 g of C8B.

Both dispersions were incubated at 47° C. for 24 hours and assessed for crystal content using an image analyzer, which quantifies crystallization in terms of birefringence. The area percent birefringence values in Table V illustrate the advantage of the coupler blend dispersions of this invention relative to single-coupler dispersions.

TABLE V

| | Area % Birefringence | |
|---|---|---|
| Dispersion | Fresh | 24 hours at 47° C. |
| C8A (comparative) | 0% | 100% |
| C8A/C8B (invention) | 0% | 8% |

EXAMPLE 6

The multilayer photographic color negative material defined below is representative of the suitable practice of this invention. Component laydowns in g/m$^2$ are listed in parentheses. Solid lines mark boundaries between layers. Structural formulas of coated components not given previously are provided immediately after.

| Multilayer Film Structure | |
|---|---|
| 1 Overcoat Layer: | Matte Beads<br>UV Absorber UV-1 (0.111) & S-1 (0.111)<br>UV Absorber UV-2 (0.111) & S-1 (0.111)<br>CD-1 Cyan Dye (0.0067) & S2 (0.0268)<br>Silver Bromide Lippman Emulsion (0.215 Ag)<br>Gelatin (1.08)<br>Bis(vinylsulfonyl)methane Hardener (at 2% by weight of total Gelatin). |
| 2 Fast Yellow Layer: | D1 (0.0452) (DIAR) & S-2 (0.0452)<br>B-1 (0.0053) BAR Coupler & S-3 (0.0053)<br>C3A (0.0181)/C3B (0.0020) Blend & S-2 (0.0201)<br>C1A (0.426)/C1B (0.047) Blend & S2 (0.473),<br>(a direct dispersion blend of this invention)<br>Silver Iodobromide Emulsion (0.570 Ag),<br>9 mole % Iodide (1.0 μm)<br>Silver Iodobromide Emulsion (0.226 Ag),<br>4 mole % Iodide T-Grain (3.0 × 0.14 μm)<br>Gelatin (1.97) |
| 3 Slow Yellow Layer: | D1 (0.0646) (DIAR) & S-2 (0.0646)<br>B-1 (0.0029) & S-3 (0.0029)<br>C3A (0.0145)/C3B (0.0016) Blend & S2 (0.0161)<br>C1A (1.259)/C1B (0.140) Blend & S2 (1.399)<br>Silver Iodobromide Emulsion (0.635 Ag),<br>6 mole % Iodide T-Grain (1.0 × 0.26 μm)<br>Silver Iodobromide Emulsion (0.249 Ag), |

-continued

| | |
|---|---|
| | 1.3 mole % Iodide T-Grain (0.55 × 0.08 μm)<br>Gelatin (2.60) |
| 4 Interlayer: | YD-2 Filter Dye (0.108)<br>Gelatin (1.29) |
| 5 Fast Magenta Layer: | M-1 (0.0624) Magenta Dye-Forming Coupler & S-4 (0.0499) & ST-1 (0.0125) Addendum<br>MM-1 (0.0538) Masking Coupler & S-4 (0.108)<br>IR-3 (0.0108) DIR & S-4 (0.0216)<br>IR-4 (0.0108) DIR & S-2 (0.0108)<br>Silver Iodobromide Emulsion (0.968 Ag),<br>4 mole % Iodide T-Grain (2.16 × 0.12 μm)<br>Gelatin (1.33) |
| 6 Mid Magenta Layer: | M-1 (0.0807) & S-4 (0.0646) & ST-1 (0.0161)<br>MM-1 (0.0646) & S-4 (0.129)<br>IR-1 (0.0236) DIAR & S-5 (0.0572)<br>Silver Iodobromide Emulsion (0.968 Ag),<br>4 mole % Iodide T-Grain (1.25 × 0.12 μm)<br>Gelatin (1.48) |
| 7 Slow Magenta Layer: | M-1 (0.258) & S-4 (0.206) & ST-1 (0.0516)<br>MM-1 (0.0646) & S-4 (0.129)<br>Silver Iodobromide Emulsion (0.602 Ag),<br>1.3 mole % Iodide T-Grain (0.55 × 0.08 μm)<br>Silver Iodobromide Emulsion (0.280 Ag),<br>4 mole % Iodide T-Grain 1.00 × 0.09 μm)<br>Gelatin (1.78) |
| 8 Interlayer: | YD-1 (0.075) Yellow Dye<br>Gelatin (1.29) |
| 9 Fast Cyan Layer: | C3A (0.0112)/C3B (0.012) Blend & S-2 (0.0124), (a direct dispersion blend of this invention)<br>CM-1 (0.0323) Masking Coupler<br>IR-1 (0.0237) DIAR & S-5 (0.0574)<br>IR-2 (0.0484) DIR & S-4 (0.194)<br>Silver Iodobromide Emulsion (1.08 Ag),<br>4 mole % Iodide T-Grain (2.6 × 0.13 μm)<br>Gelatin (1.36) |
| 10 Mid Cyan Layer: | C3A (0.203)/C3B (0.023) Blend & S-2 (0.0226)<br>CM-1 (0.0215)<br>IR-1 (0.0108) & S-5 (0.216<br>Silver Iodobromide Emulsion (0.699 Ag),<br>4 mole % Iodide T-Grain (1.3 × 0.12 μm)<br>Gelatin (1.66) |
| 11 Slow Cyan Layer: | C3A (0.484)/C3B (0.054) Blend & S-2 (0.538)<br>CM-1 (0.0323)<br>B1 (0.0377) & S-3 (0.0377)<br>Silver Iodobromide Emulsion (0.473 Ag)<br>1.3 mole % Iodide T-Grain (0.55 × 0.08 μm)<br>Silver Iodobromide Emulsion (0.463 Ag),<br>4 mole % Iodide T-Grain (1.00 × 0.09 μm)<br>Gelatin (1.83) |
| 12 Antihalation Layer: | Gray Silver (0.22 Ag)<br>Gelatin (2.44) |

Cellulose Triacetate Support

S-1

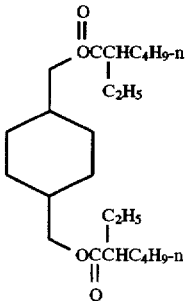

S-2

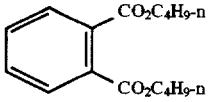

-continued
S-3
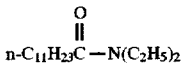
S-4
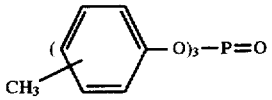
mixed isomers
S-5
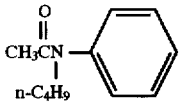
UV-1
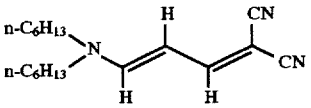
UV-2
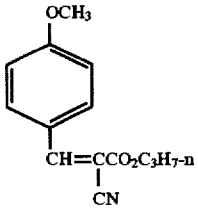
CD-1
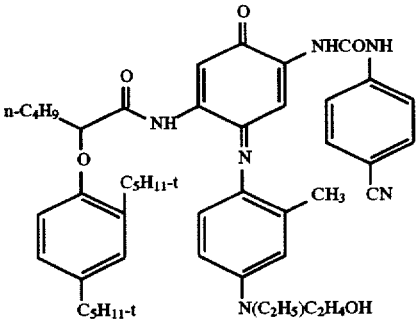
B-1
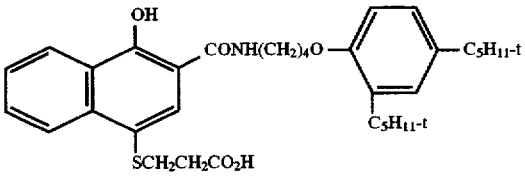
M-1

-continued
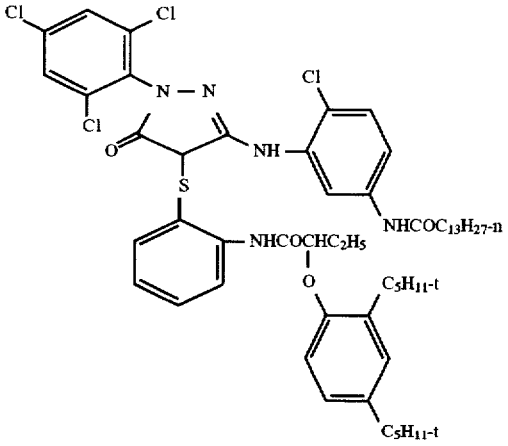
YD-2
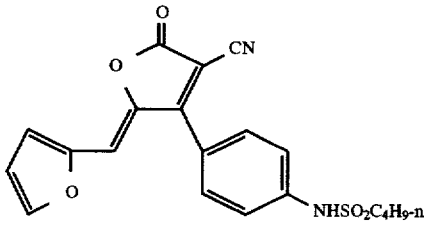
ST-1
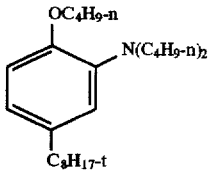
MM-1
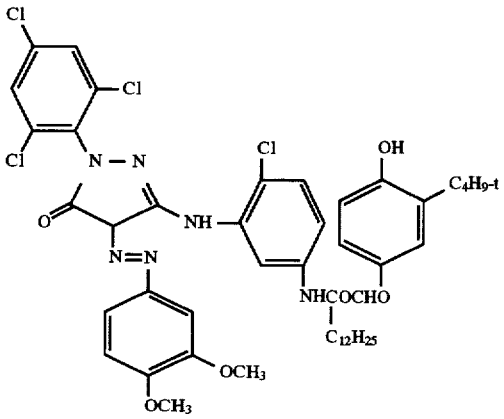
YD-1

-continued
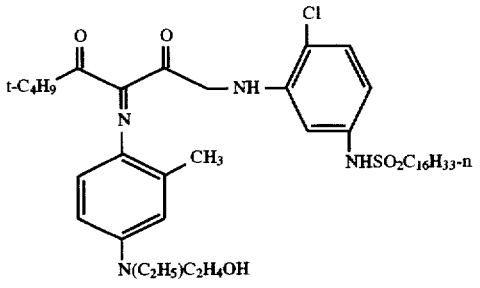
IR-1
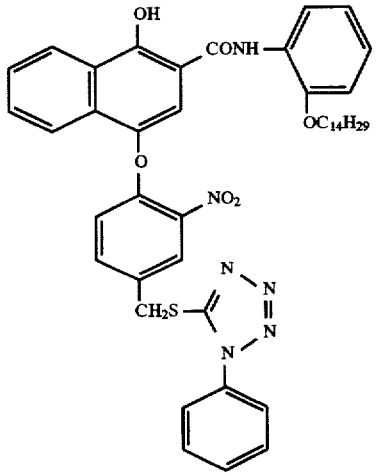
IR-2
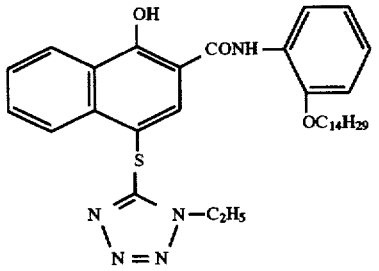
IR-3
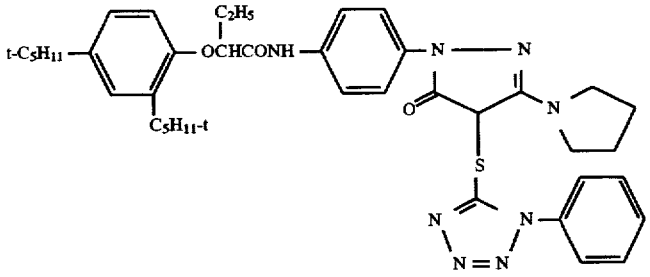
IR-4

-continued

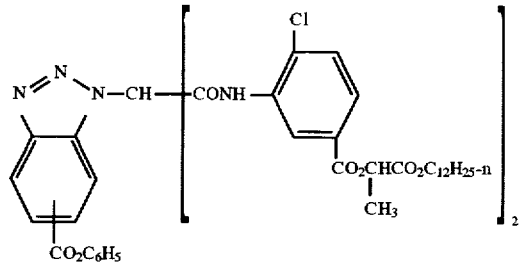

D-1

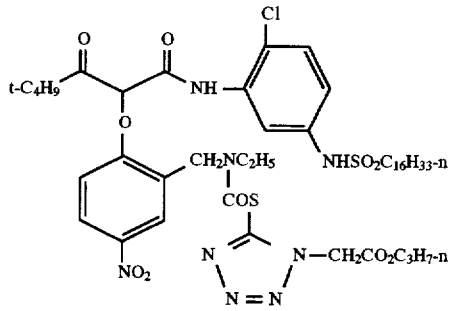

CM-1

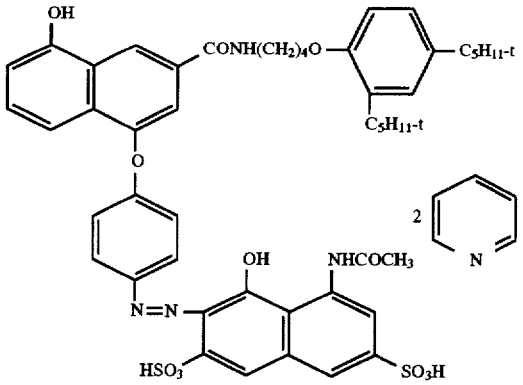

The above material provides an excellent color negative film whose robustness and coating reproducibility are aided by the use of coupler dispersion blends of this invention. Exposed film samples of the above described material may be advantageously processed using the Kodak C-41 processing chemistry and protocol.

What is claimed is:

1. A coupler dispersion comprising an aqueous medium having dispersed therein an organic phase comprising (i) a primary photographic coupler comprising a first ballasting group containing at least 5 carbon atoms and (ii) an auxiliary photographic coupler comprising a second ballasting group, wherein the primary coupler and the auxiliary coupler are present in the dispersion at a weight ratio of from 4:1 to 99:1 and the auxiliary coupler differs from the primary coupler solely in that the second ballast group contains 2 or more additional carbon atoms and associated hydrogen atoms relative to the first ballasting group.

2. A dispersion according to claim 1, wherein the ballasted primary coupler comprises at least 80% by weight of the total coupler in the dispersion, and the auxiliary ballasted coupler comprises from 1 to 20% by weight of the total coupler in the dispersion.

3. A dispersion according to claim 1, wherein the auxiliary coupler is present at 3 to 15% by weight of the primary coupler.

4. A dispersion according to claim 1, wherein the dispersed organic phase further comprises a permanent coupler solvent.

5. A dispersion according to claim 4, wherein the primary and auxiliary couplers are codispersed with a permanent coupler solvent at a weight ratio of total coupler:coupler solvent of from 1:0.1 to 1:8.0.

6. A dispersion according to claim 5, herein the total coupler:coupler solvent weight ratio is from 1:0.2 to 1:2.

7. A dispersion according to claim 1, wherein the ballast group of the primary coupler contains at least 6 carbon atoms.

8. A dispersion according to claim 1, wherein the ballast group of the primary coupler contains from 10 to 24 carbon atoms.

9. A dispersion according to claim 1, wherein the second ballast group contains at least 3 additional carbon atoms relative to the first ballast group.

10. A dispersion according to claim 1, wherein the second ballast group contains at least 4 additional carbon atoms relative to the first ballast group.

11. A dispersion according to claim 1, wherein the second ballast group contains 3–10 additional carbon atoms relative to the first ballast group.

12. A dispersion according to claim 1, wherein the ballast group of the auxiliary coupler contains at least three additional methylene groups relative to the first ballast group.

13. A dispersion according to claim 1, wherein the ballast group of the auxiliary coupler contains an additional branched alkyl group relative to the first ballast group.

14. A dispersion according to claim 1, wherein the primary coupler is a ballasted cyan, magenta or yellow dye-forming coupler.

15. A dispersion according to claim 14, wherein the primary and auxiliary couplers are yellow dye-forming couplers.

16. A dispersion according to claim 15, wherein the yellow dye-forming couplers are pivaloylacetanilide couplers.

17. A dispersion according to claim 14, wherein the couplers are magenta dye-forming couplers.

18. A dispersion according to claim 17, wherein the magenta dye-forming couplers are 1-phenyl-5-pyrazolone couplers.

19. A dispersion according to claim 14, wherein the couplers are cyan dye-forming couplers.

20. A dispersion according to claim 19, wherein the cyan dye-forming couplers are 2-ureido-5-carbonamidophenol couplers.

21. A photographic element comprising one or more light-sensitive silver halide emulsion coated on a support and one or more coupler dispersions according to claim 1 coated in one or more layers on the support.

22. A process for forming a coupler dispersion according to claim 1 comprising codispersing the primary and auxiliary couplers with a permanent coupler solvent at a weight ratio of total coupler:coupler solvent of from 1:0.1 to 1:8.0 in the absence of any removable auxiliary solvent.

23. A coupler dispersion comprising an aqueous medium having dispersed therein an organic phase comprising (i) a primary photographic coupler comprising a first ballasting group containing at least 5 carbon atoms and (ii) an auxiliary photographic coupler comprising a second ballasting group, wherein the auxiliary coupler is present in the dispersion at a relatively minor weight percentage with respect to the primary coupler and the auxiliary coupler differs from the primary coupler solely in that the second ballast group contains from 3 to 10 additional carbon atoms and associated hydrogen atoms relative to the first ballasting group.

* * * * *